United States Patent [19]

McMillin

[11] Patent Number: 4,687,120

[45] Date of Patent: Aug. 18, 1987

[54] METHOD AND APPARATUS FOR DISPENSING COLD BEVERAGE

[75] Inventor: John R. McMillin, Maplewood, Minn.

[73] Assignee: The Cornelius Company, Anoka, Minn.

[21] Appl. No.: 781,158

[22] Filed: Sep. 27, 1985

Related U.S. Application Data

[63] Continuation of Ser. No. 453,183, Dec. 27, 1982 abandoned.

[51] Int. Cl.[4] ..... B67D 5/56

[52] U.S. Cl. ..... 222/1; 62/306; 62/338; 62/394; 62/453; 222/129.1; 222/146.6; 222/334

[58] Field of Search ..... 222/129, 129.1–129.4, 222/146.6, 1, 334, 255; 62/306, 338, 453, 394–397

[56] References Cited

U.S. PATENT DOCUMENTS

| | | | |
|---|---|---|---|
| 2,545,749 | 3/1951 | Pusch | 62/394 X |
| 2,547,423 | 4/1951 | Wegman et al. | 222/129.2 |
| 2,838,917 | 6/1958 | Smithson | 62/453 X |
| 3,232,489 | 2/1966 | Buffington | 222/129.1 X |
| 3,240,395 | 3/1966 | Carver | 222/129.1 |
| 3,503,540 | 3/1970 | Fuerst | 222/129.1 |
| 3,583,601 | 6/1971 | Ayers | 222/129.1 X |
| 3,622,044 | 11/1971 | Wilson | 222/16 |
| 3,627,175 | 12/1971 | Hisada | 222/14 |
| 3,813,010 | 5/1974 | Hassell et al. | 222/129.1 |
| 3,904,079 | 9/1975 | Kross | 222/108 X |
| 4,076,145 | 2/1978 | Zygiel | 222/129.2 X |
| 4,496,080 | 1/1985 | Farber et al. | 222/129.3 |
| 4,566,287 | 1/1986 | Schmidt et al. | 222/129.3 X |

*Primary Examiner*—Joseph J. Rolla
*Assistant Examiner*—Kevin P. Shaver
*Attorney, Agent, or Firm*—Henry C. Kovar

[57] ABSTRACT

A cold beverage dispensing apparatus is powerable by compressed gas and has a thermally insulated cabinet having a cooling chamber containing a source of compressed gas and a water reservoir and a normally non-pressurized syrup pump fluidly connectible to a non-pressurized syrup tank in the chamber, a dispensing nozzle and a manual actuator are on the outside of the cabinet, a pneumatic power valve is operable to connect the gas source to the pump and expel syrup to the nozzle, a pneumatic water valve servo is connected to all of the power valves and the opening of any power valve will effect operation of the servo and opening of the water valve, the pump is inside of the syrup tank and used propellant gas is vented inside the cabinet, a gas bottle and the syrup tanks are racked on the inside of a cabinet door and the power valves are pneumatically connected in series between the gas source and the water reservoir. A method of dispensing cold beverage includes the steps of cooling water and syrup to just above freezing, pressurizing the water, transferring non-pressurized syrup under gravity into a non-pressurized syrup pump and concurrently dispensing water and syrup by opening a water valve and applying the compressed gas pressure upon beverage in the pump, and terminating dispensing by venting used gas into a common cooling chamber.

38 Claims, 12 Drawing Figures

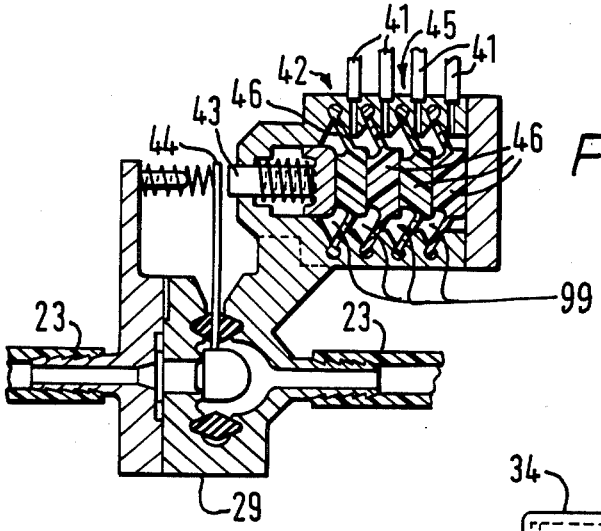
FIG.9.
FIG.10.
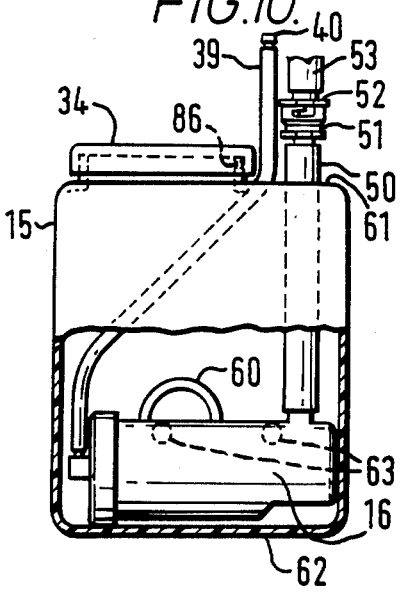
FIG.11.
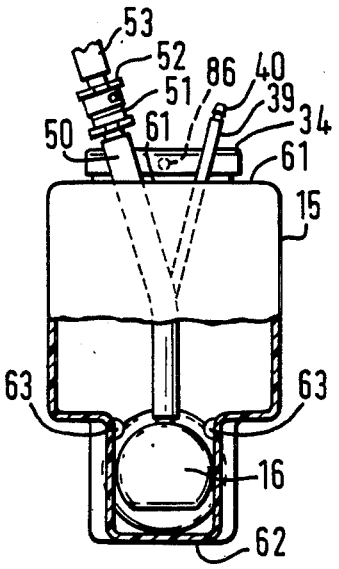
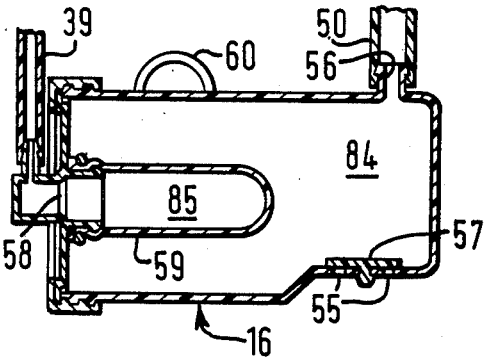
FIG.12.

METHOD AND APPARATUS FOR DISPENSING COLD BEVERAGE

This is a co-pending continuation of U.S. Ser. No. 453,183 filed on Dec. 27, 1982 now abandoned.

BACKGROUND OF THE INVENTION

1. Field of the Invention

This invention pertains to an apparatus and a method for dispensing cold post-mixed beverage using compressed gas for pneumatic power of the dispenser.

2. The Prior Art

The accepted procedure and structure for dispensing post-mix beverages utilizes stainless steel syrup tanks. The tanks are filled at a bottling or distribution center, pressurized, and then transported to a place of use. The tanks always remain pressurized and are connected to a carbon dioxide bottle and kept pressurized during dispensing. The tank size must be of about five gallons in order to be economically viable or the container cost per unit of volume becomes excessive. However, this five-gallon tank is quite heavy and its use is restricted to commercial distribution channels such as restaurants and bars. A continually pressurized tank also requires an educated and knowledgable user who can connect and disconnect the pressurized tanks without leakage. The pressurized tank must be returned after usage, for cleaning and refill for its next trip, and therefore two-way transportation over predetermined routes is a business necessity. The usage of pressurized tanks does not lend itself to domestic beverage dispensers, the domestic distribution channels or to use by unskilled people.

An alternative to the usage of pressurized tanks is usage of a package called the bag-in-box (BIB). The BIB is a plastic bag inside of a cardboard box. The bag is not pressurized and beverage is drawn out of the bag by a suction pump which may be electrical or gas powered. The BIB has enjoyed limited success for soft drink syrups. There have been many problems including pump failure, leakage, pump burn-out, seal failure, and bag leakage. The BIB has enjoyed greater success as a retail package for wines, where there has been no need to use a pump. The BIB has been of 2–5 gallons in order to be an economically viable package. Smaller package sizes such as the sizes typically retailed, are not economically effective. Fluid connection to a BIB has been troublesome and leakage is all too frequent.

Attempts have been made to devise a compressed gas powered beverage dispenser that does not require electricity for power of beverage pumps. There have been some technical successes but there examples are extremely complicated, failure-prone, and costly. These devices have not been successful in the marketplace even when embodied as relatively expensive vending machines. These machines have been very difficult to keep clean, very difficult to sanitize, and very difficult to repair. The prior art also has never been able to integrate the beverage pump and tanks into a goof-proof and leak-proof package.

OBJECTS OF THE INVENTION

It is an object of the present invention to provide an improved cold beverage dispensing apparatus which is powerable by compressed gas.

It is an object of the present invention to provide an improved, simplified, and economical structure for a compressed gas powerable beverage dispenser.

It is an object of the present invention to provide an improved refrigeration and cabinet structure for a cold beverage dispenser.

It is an object of the present invention to provide a multi-flavor post-mix beverage dispenser powerable by compressed gas and having a pneumatic servo system to open a water valve.

It is an object of the present invention to provide an improved method of dispensing post-mix beverage utilizing compressed gas for pumping syrup from a normally non-pressurized pump and syrup tank.

It is an object of the present invention to provide a post-mix carbonated beverage dispensing apparatus that is technically and economically suitable for use in a domestic household having no training in the art and devices of beverage dispensing.

SUMMARY OF THE INVENTION

In accordance with the principles of the present invention, a cold beverage dispensing apparatus powerable by compressed gas has a cabinet with a cooling chamber containing a refrigeration evaporator, a source of compressed gas at a regulated pressure, a water reservoir, a non-pressurized syrup tank and a normally non-pressurized syrup pump fluidly connected to the tank; a normally closed water valve is connected to the reservoir, a dispensing nozzle is on the outside of the cabinet and is connected to the water valve and syrup pump, a pneumatic power valve is in between the gas source and the syrup pump, and a manual actuator is connected to the power valve to selectively effect connection of the gas source to the pump and to open the water valve.

In further accordance with the present invention, a pneumatically powerable multi-flavor post-mix beverage dispenser has a source of carbon dioxide gas, a source of cold carbonated water, a plurality of pneumatically powerable syrup pumps each of which is connected to a non-pressurized syrup tank, a water valve, a dispensing nozzle connected to the water valve and the pumps, a pneumatic servo connected to open the water valve, a plurality of pneumatic power valves for dispensing, each power valve having an inlet connected to the gas source, an outlet connected to a respective pump and the servo, a vent to atmosphere, a valve element normaly connecting the pump and servo to the vent, and a dispensing actuator which moves the valve element and connects the gas source to the pump and the servo for effecting concurrent syrup pumping and water flow to the nozzle.

A method of dispensing in accordance with the present invention includes the steps of cooling a reserve of water and a tankfull of non-pressurized syrup to just above freezing, pressurizing the water with compressed gas, transferring syrup by gravity from the syrup tank into a non-pressurized syrup pump and maintaining the syrup in the pump at least as cool as the tank syrup, concurrently dispensing cooled water and syrup at substantially the same pressure and temperature by connecting the compressed gas to the syrup pump and pumping syrup at and with the pressure of the gas while opening a water valve and propelling water under the gas pressure, combining the flows of syrup and water to form a beverage, and terminating dispensing by closing the water valve and disconnecting the gas from the pump and then venting used gas into a cooling chamber which commonly cools the reservoir, tank and pump.

BRIEF DESCRIPTION OF THE DRAWINGS

FIG. 9 is a detail view of a servo operated water valve in the apparatus of FIG. 2;

FIG. 10 is an elevational side view in partial section of a syrup tank and pump of the apparatus of FIG. 2;

FIG. 11 is an elevational end view in partial section of the structure of FIG. 10; and FIG. 12 is a side elevational detail view of the pump of the apparatus of FIGS. 2 and 10.

AS SHOWN ON THE DRAWINGS

Figure 1:
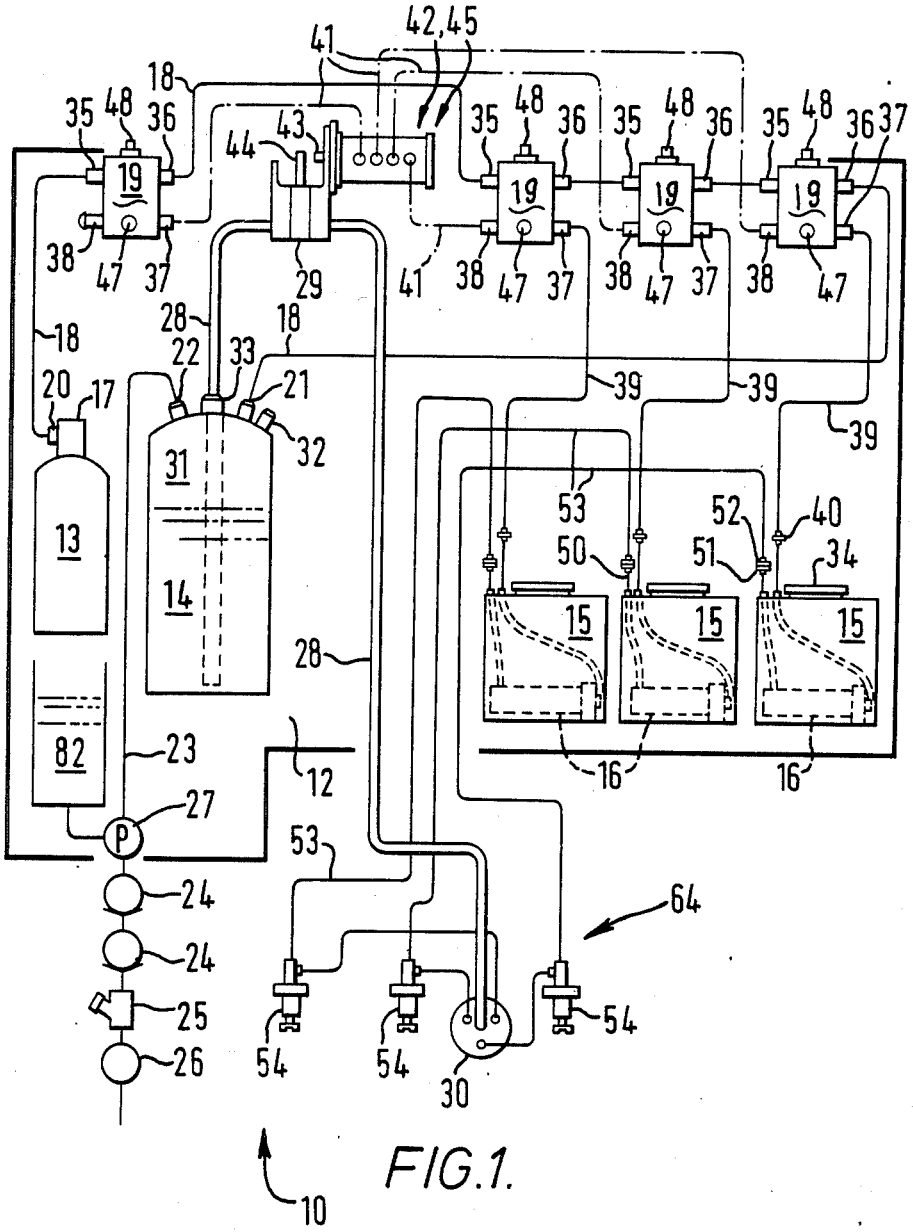
FIG. 1 is a schematic of the fluid elements and connections of the preferred embodiment of an apparatus for dispensing beverage.

The principles of the present invention are particularly useful when embodied in cold beverage dispensing apparatus schematically represented in FIG. 1 and generally indicated by the numeral 10. The apparatus 10 has a thermally insulated cabinet 11 having a cooling chamber 12 which contains a compressed gas source 13, a water reservoir 14, non-pressurized syrup tanks 15 and normally non-pressurized syrup pumps 16.

The gas source 13 is a bottle having an integral pressure regulator 17 set at a predetermined propellant pressure. The water reservoir 14 is a thermally conductive metal tank sized to hold a plurality of servings of water, for example at least 4 liters and preferably 20 liters or so. The reservoir 14 is connected to the gas source 13 by a supply line 18 which extends through pneumatic dispensing power valves 19 from a quarter turn gas connector 20 connected to the regulator 17. The reservoir 14 has a gas inlet 21, a water inlet 22 connected to a water supply line 23 having a double check valve 24, a water filter 25 and shut-off device 26. A water pump 27 may be provided inside of the chamber 12 for filling the reservoir 14. A water dispensing line 28 leads from a water outlet 33 of the reservoir 14 to a normally closed water valve 29 and then to an external dispensing nozzle 30 which is on the outside of the cabinet 11. The reservoir 14 water level is maintained well below the top of the reservoir 14 by a conventional float and needle valve (not shown) and there is a propellant gas head space 31 above the water. An automatic pressure relief valve 32 is on top of the reservoir 14 in fluid communication with the head space 31; the relief valve 32 vents to atmosphere in the cooling space 12.

Each syrup tank 15 has a normally closed but removable filling cover 34 and a breather aperture 35 which vents the tank 15 to atmosphere within the cooling chamber 12 and which keeps the inside of the tank 15 non-pressurized and at atmospheric pressure. Each power valve 19 has a gas inlet 35 and a first gas outlet 36. The power valves 19 are connected in series in the gas supply line 18 with the inlet 35 of a first power valve 19 being directly connected to the gas source 13, and the first outlet 36 of the last power valve 19 being connected to the head space 31, and the first outlet 36 of the first power valve 19 being connected to a inlet 35 of the second or next power valve 19 and so on until a first outlet 36 of the next to last power valve 19 is connected to a inlet 35 of the last power valve 19. Each power valve 19 further includes a power outlet fluidly discrete from the first outlet 36. The power outlet is fluidly split into a second outlet 37 and a third outlet 38. Each second outlet 37 is connected to a propellant gas delivery line 39 which goes through a disconnect 40 to a respective syrup pump 16. Each third outlet 38 is connected by a servo propellant gas line 41 to a pneumatically operable servo 42 having a hammer 43 for forcing a valve anvil 44 to effect opening of the water valve 29. Within the servo 42 is a pneumatic OR logic mechanism comprised of diaphragms 46 between the hammer 43 and the servo lines 41; a diaphragm is also between each pair of adjacent servo lines 41. Each power valve 19 has a vent 47 to atmosphere within the cooling chamber 12 and a valve element 48 having a normal position in which the inlet 35 and outlet 36 and the gas source 13 are closed to the outlets 37, 38 and in which the vent 47 is fluidly connected to the outlets 37, 38 and thereby to a respective syrup pump 16. The valve element 48 is movable to an alternate dispensing position in which the inlet 35 and outlet 36 and the gas source 13 are fluidly connected to the outlets 37, 38, and to a respective syrup pump 16 and the servo 42, and in which the outlets 37, 38 are closed to the vent 47. The valve element 48 is spring biased and mono-stable and automatically returns to the normal position. Each of the outlets 37, 38 has a flow restrictor 49 which seems to keep the surge of propellant gas from blowing off unclamped and frictionally secured propellant lines 39, 41.

A syrup dispensing line 50 extends from a respective syrup pump 16 to the nozzle 30. Each dispensing line 50 has an open disconnect 51 connected to a normally closed check valve and disconnect 52 in a further dispensing line 53 which is connected to an adjustable flow restrictor 54 alongside the nozzle 30. Each syrup pump 16 has a syrup inlet 55 in fluid communication with the inside of a respective syrup tank 15, and a syrup outlet 56 to which a respective dispensing line 50 is connected. A self-checking fill valve 57 allows syrup to flow into the pump 16 but prevents flow of syrup from the pump 16 back to the tank 15. The propellant line 39 is connected to a propellant port 58 and an expandable elastomeric bladder 59 separates propellant gas from syrup. The pump 16 is preferably within the tank 15, and is insertable through the withdrawable out of the tank 15 when the cover 34 is removed. An upward extending pump handle 60 enables manual insertion and removal of the pump 16 with respect to the tank 15. Each tank 15 has a top wall 61 through which both the beverage dispensing line 50 and the propellant line 39 extend. The tank 15 has no openings below the top wall 61 and the pump 16 is held against a tank bottom 62 by inwardly dimpled retainers 63 which frictionally engage the pump 16 but are flexible enough to allow the pump 16 to be manually pulled out by the handle 60. The nozzle 30 is mounted in a dispensing station 64 which is mounted on the outside of a normally closed cabinet door 65. The station 64 has a drip tray 65, downwardly depressable actuator buttons 66 which engage respective power valves 19 and effect pressurization of a selected pump 16 and the servo 42 to open the water valve 29, and a removable nozzle cover 67 that normally covers the adjustable syrup flow restrictors 54. The cabinet 11 includes a box 68 having a back panel 69 upon which is mounted a refrigeration condenser 70. A pair of wheels 71 are mounted under the back panel 69 on opposite corners and a pair of fold-out spacer handles 72 are mounted on opposite corners adjacent an upper edge 73 of the back panel 69. The water reservoir 14, which is the heaviest single structure in the apparatus 10, is mounted adjacent the back panel 69 and the heavy refrigeration compressor 74 is mounted directly under the reservoir 14 and between the wheels 71 for stability. In the cooling chamber 12 is a U-shaped refrigerant evaporator 75 having extended legs 76 facing toward the cabinet door 65. The water reservoir 14 has a circular section when viewed from above and the length of each evaporator leg 76 is greater than a diameter of the reservoir 14 so that the reservoir 14 is completely within the evaporator 75 when viewed from above. Cabinet hinges 77 pivotally mount the door 65 to one side edge of the box 68 and the door 65 is openable about a vertical axis defined by the hinges 77. On the inside of the door 65 is a tank rack 78 for the syrup tanks 15, and a bottle rack 79 for the gas source 13. At the top of the door 65 is a control chamber 80 which houses the power valves 19, the servo 42 and the water valve 29. The control chamber 80 is fluidly open to the cooling chamber 12, but access and view are blocked by a removable control chamber cover 81. The control chamber 80 is in direct fluid communication with the cooling chamber 12 and is considered to be part of the cooling chamber 12.

The apparatus 10 may alternatively not be connected to a running water supply and may be provided with a water vat 82 inside of the cooling chamber 12. The water vat is connected to an inlet of the pump 27 and the pump 27 is under the control of a conventional water level control (not shown) for the reservoir 14. There is an advantage to the vat 14 in that it can be filled with ice and water to assist cooling and increase the cold drink capacity of the apparatus 10.

Figure 2:
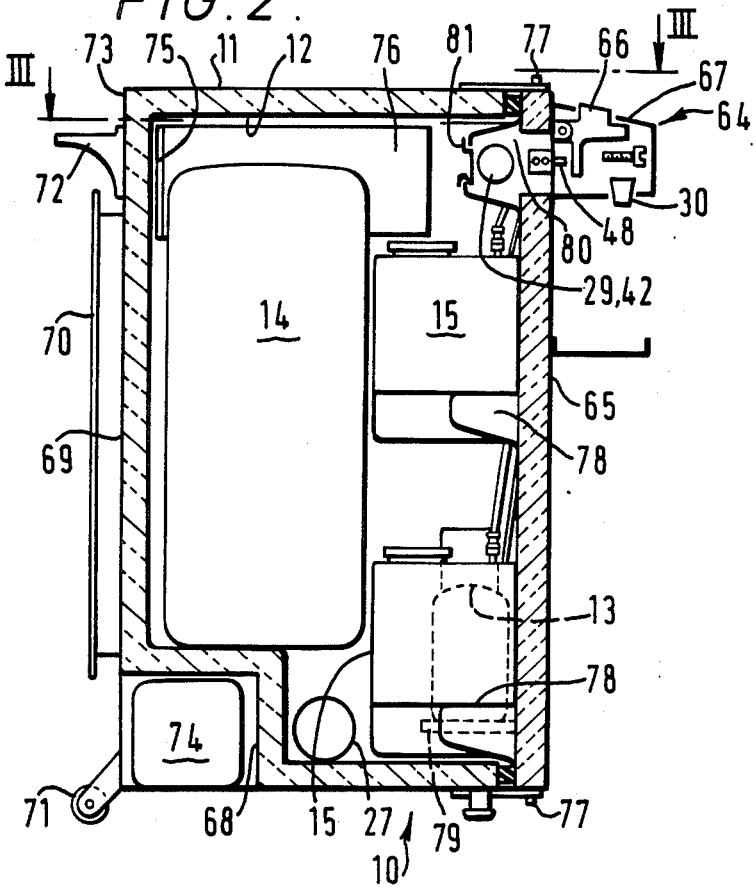
FIG. 2 is a simplified elevational view in section through the preferred structural embodiment of the present invention with fluid lines being omitted for the purpose of clarity.
Figure 3:
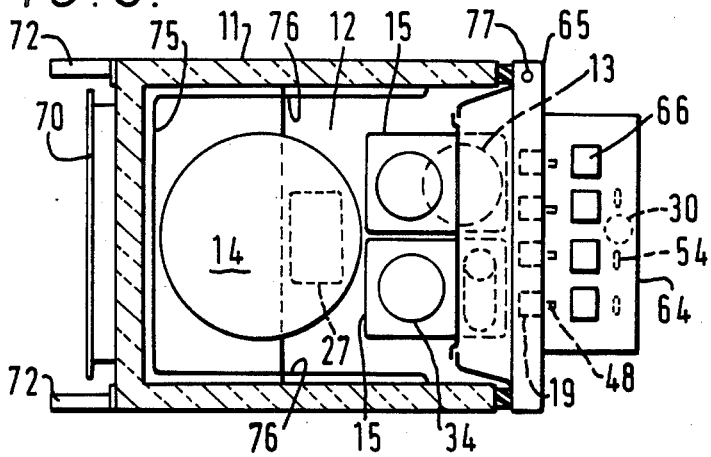
FIG. 3 is a downward looking section view through lines III—III of FIG. 2.

FIGS. 2 and 3 best show the efficient and effective arrangement of the structure in the apparatus 10. The evaporator 75 is positioned near the top of the cooling chamber 12 with the closed end of the U-shape at the rear with the legs 76 extending toward the door 65. The water reservoir 14 is within the U-shaped evaporator 75 as best seen in FIG. 3, and the reservoir 14 is backed up against the back panel 69 while leaving room for the evaporator 75 and a downward flow of cold air between the back panel 69 and the reservoir 14. The syrup tanks 15 are supported by the tank racks 78 on the inside of the door 65. The tanks 15 are positioned side by side to one another at the open end of the U-shaped evaporator 75 which gives a static cooling preference to the reservoir 14 without the use of a fan. The gas bottle 13, which is preferably a bottle of high pressure carbon dioxide gas, is supported by the bottle rack 79 on the inside of the door 65. The gas bottle 13 is supported closely adjacent to the axis of the hinges 77. The optional water pump 27 is in the cooling chamber 12 under the reservoir 14. The optional water vat 82 may replace the lowermost syrup tank 15 (if and when the vat 82 is used. The dispensing power valves 19, the servo 42 and the water valve 29 are all in the control chamber 80 of the door 65. The chamber cover 81 conceals the tubing, valves and various components in the control cahmber 80 but lets vented propellant gas into the cooling chamber 12. The downwardly depressable actuators 66 are connected to pivot and push in the valve elements 48. The downward force resisted by the buttons 66 gives no lateral force to move the apparatus 10 on the floor upon which it rests. The compressor 74 being under the reservoir 14 and laterally between the wheels 71, concentrates the weight of the apparatus 10 just forward of the wheels 71 and a child may easily grasp the spacer handles 72 and move the apparatus 10 about. The spacer handles 72 also serve to space the apparatus 10 off of a building wall for ensuring an upward convective air flow over the compressor 74 and condenser coil 70. FIGS. 2 and 3 are shown without tubing for purposes of clarity.

Figure 4:
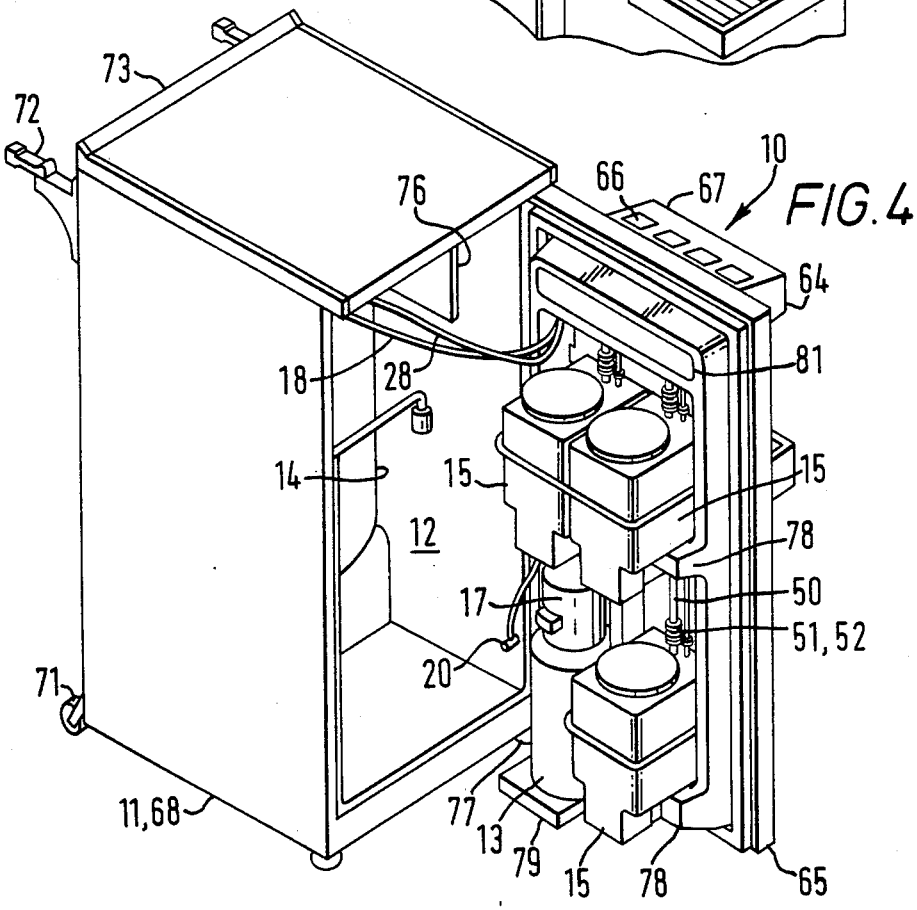
FIG. 4 is a perspective view of the structure of FIG. 2 with a front door opened to show the contents of the cabinet.

In FIG. 4, the door 65 is shown opened and the syrup tank 15 and gas bottle 13 all swing out into a postiion of unobstructed access in which the bottle 13 can be removed and/or changed, and in which the tank covers 34 can be removed for easy filling without removal of the tanks 15 from the tank racks 78. The placement of the reservoir 14 and compressor 74 adjacent the back panel 69 each gives increased stability to the apparatus 10 when the door 65 is opened, so the apparatus will not fall over forward.

Figure 5:
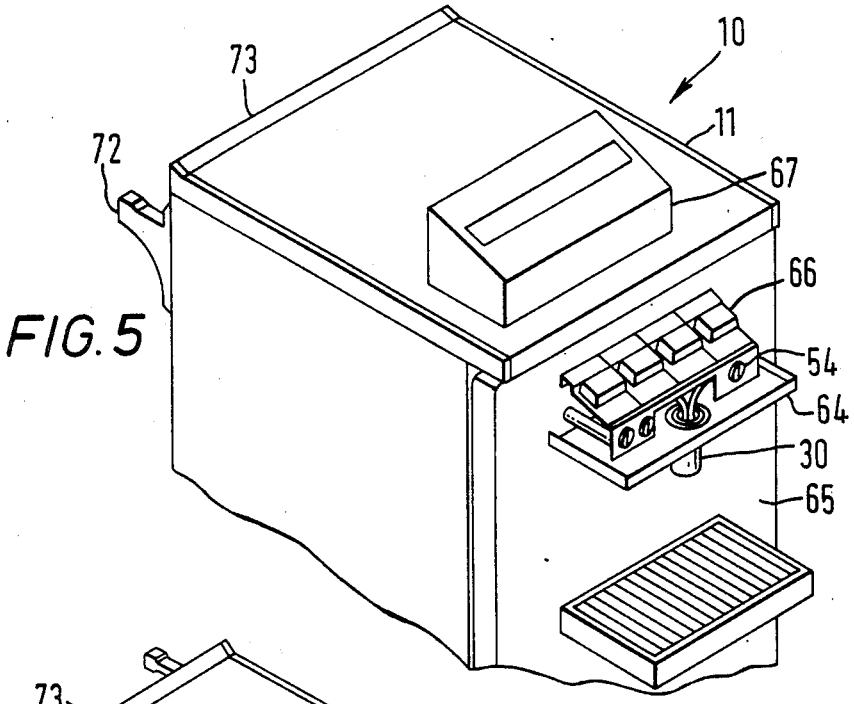
FIG. 5 is a perspective view of the structure of FIG. 2 with a nozzle cover removed and sitting on top of the cabinet.

In FIG. 5, the door 65 is shown closed with the nozzle cover 67 removed from the dispensing station 64, for access to the adjustable flow restrictors 54, and to the dispensing actuators 66 and the connections on the nozzle 67. The drip tray 65 is removable for disposal of its contents. The valve elements 48 are removable out the front upon removal of the actuator buttons 66.

Figure 6:
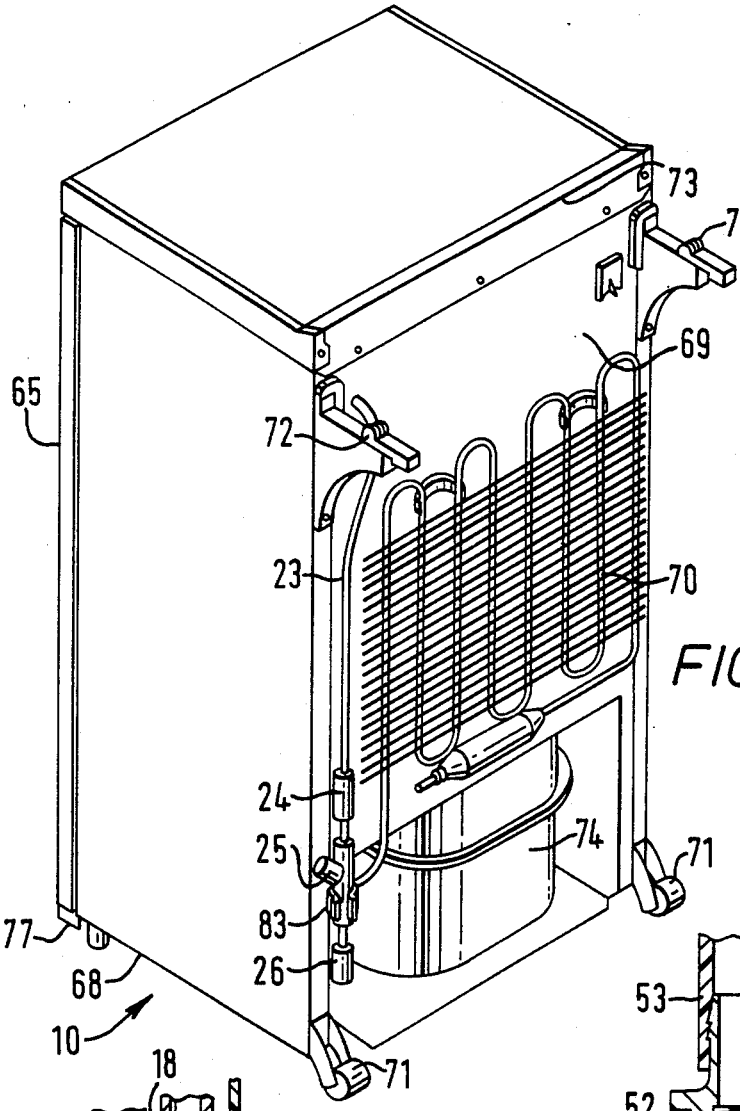
FIG. 6 is a perspective view of the back side of the apparatus of FIG. 2.

FIG. 6 shows the water inlets enabling connection to virtually all municipal water supplies. The water supply line 23 comes through the back panel 69 and runs down the back panel 69 to one side of the condenser 70. The water line 23 has an external double check valve 24 to prevent reverse flow of water back into a municipal supply, a water filter 25 and a shut-off valve or disonnect 26. The water line 23 is very flexible plastic tubing and is held in place by a clamp 83 which frictionally grasps and holds the filter 25. When the filter 25 is held by the clamp 83, the plastic tubing is stretched taut. The water supply line 23 and its components are kept in place by the clamp 83 and are protected from damage by the spacer handles 72. Yet, the filter 25 may be pulled out of the clamp 83 and the line 23 and its components may be moved to a position of each access for inspection, repair, connection or disconnection, cleaning of the filter 25 or shut-off.

Figure 7:
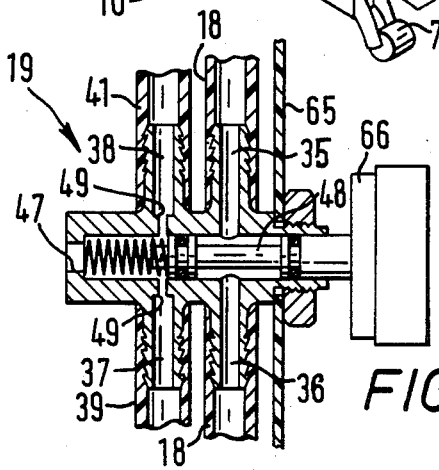
FIG. 7 is a detail sectional view of a power valve in the apparatus of FIG. 2.

A pneumatic power valve 19 is shown in detail in FIG. 7. The spring-biased valve element 48 is shown in the normal position and is pushed rearward to the alternate dispensing position. The flow restrictor 49 helps with clampless tubing connections which are held on the pump 16, the servo 42, and the power valve 19 by friction.

Figure 8:
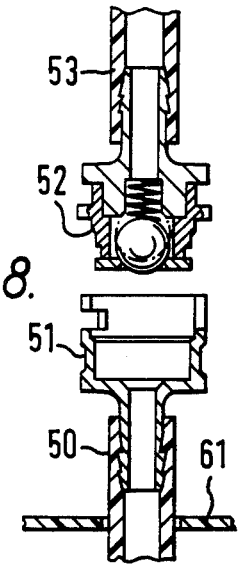
FIG. 8 is a detail sectional view of a disconnect structure in the apparatus of FIG. 2.

The beverage disconnect 51 is shown in detail in FIG. 8. The open disconnect 51 comes apart from the normally closed check 52 to disconnect the beverage dispensing line 50 from the further line 53. The adjustable flow restrictors 54 in the further lines 53 are of the screw valve type. The servo 42 and water valve 29 are detailed in FIG. 9. Regardless of which servo propellant line 41 is pressurized, the hammer 43 is driven out to engage the anvil 44 and open the water valve 29. The diaphragm 46 affects the OR logic device of the servo 42 by fluid tightly separating servo pressure chambers 99 for each power valve 19 from other servo chambers 99.

A syrup tank 15 and pump 16 are detailed in FIGS. 10, 11 and 12. The pump 16 is shown in its preferred location inside the tank 15. The fill cover 34 shields the breather 86 which keeps the tank 15 non-pressurized. The beverage dispensing line 50 and the gas propellant line 39 both go through apertures in a top wall 61 of the tank and there are no apertures of any kind in the tank 15 so that there is no possibility of leaks. The pump 16 is retained on the bottom 62 of the tank 15 by the retainers 63 which are inward facing dimples that hold the pump 16 to the bottom 62. The syrup pump 16 has its inlet 55 in fluid communication with the inside of the tank 15 and a filling check valve 57 automatically opens the inlet 55 to allow syrup flow into the pump 16 and automatically closes to prevent flow from the pump 16 back to the tank 15. The beverage outlet 56 is connected to the dispensing line 50 which has an open half of a disconnect 51 which easily connects to or disconnects from the normally closed check valve/disconnect 52. The bladder 59 divides the inside of the pump 16 into a pumping chamber 84 and propellant chamber 85. A propellant port 58 extends into the propellant chamber 85 and is connected to the propellant delivery line 39 which has a disconnect 40. An upward extending handle 60 enables manual insertion and removal of the pump 16 into and from the tank 15 through the top wall 61 when the cover 34 is removed.

In operation of the apparatus 10 and in the practice of the method of the present invention, a compressed gas bottle 13, having either compressed air or carbon dioxide is placed in the cooling chamber 12 and connected to the supply line 18. The gas bottle 13 has a tamperproof preset pressure regulator 17 and the gas disconnect/connector 20 hooks into an outlet of the regulator 17; no setting of pressures is required in the apparatus 10, and the regulator 17 goes with the bottle for refill and the regulator 17 is checked by the filler of the bottle 13. The regulator 17 maintains a predetermined and preset 25 PSIG pressure. Upon such connection, all of the power valves 19 and the water reservoir 14 are supplied with gas pressure. The water supply line 23 is connected and opened and the reservoir 14 is filled with water to the desired level while a head space 31 of compressed gas is maintained above the water. The water is sprayed into the reservoir 14 for carbonation, and a conventional porous stone (not shown) admits carbon dioxide gas at the bottom of the reservoir 14 if the apparatus 10 is making carbonated beverage. Each syrup tank 15 is filled with beverage syrup. Examples of beverage syrups, sometimes called concentrates, are concentrated syrups for the non-carbonated beverages such as fruit juices, punch, tea, flat wines, cold coffee and dairy beverages. Examples of syrups for carbonated drinks include colas, lemon-lime, orange, dietetic beverages and the like. If alcoholic drinks are to be served, alcoholic beverage may be placed in the tank 15. During the initial fill of each tank 15, the retainers 63 hold the air filled pump 16 down on the bottom 21 so the pump 16 does not float to the top of the tank 15 and turn upside down. To fill the pump 16, an actuator 66 is depressed and a valve element 48 pushed in. Compressed gas is supplied to the pump 16 which inflates the bladder 59 and expels air from the pumping chamber 84. The actuator 66 is released and the valve element 48 returns to its normal position and the pump propellant chamber 85 vents to atmosphere and the bladder 59 collapses as the beverage comes into the pumping chamber 84 under the influence of gravity from the non-pressurized tank 15. A second such priming actuation will usually purge air from the dispensing line 50 and the apparatus 10 is primed. It is necessary to likewise prime all of the pumps 16 and dispensing lines 50. When the refrigeration is turned on, the water reservoir 14 is given a preference to the refrigeration cooling by virtue of a downdraft on three sides, specifically left, back and right sides, and the much smaller and less important syrup tanks 15 are given what's left. When the apparatus 10 is cooled overnight, the water and syrups will both be cooled to the same temperature, just above freezing, for example 35° F. (1° C.). After being filled and cooled down, the adjustable flow regulator 54 is manually set to give a correct ratio of syrup flow to water flow and the apparatus 10 is ready to dispense post-mix type beverages. The reservoir 14 and each tank 15 hold at least a day's supply of cooled water and syrup respectively.

In the dispensing of a serving of beverage, a selected actuator 66 is pushed down. The actuator 66 depresses a valve element 48. The depressed valve element 48 fluidly connects the power valve inlet 35 and outlet 36 to the outlets 37, 38 and thereby connects the gas source 13 to a respective pump 16 for a selected beverage, and to the servo 42. The power valve vent 47 is also closed. The servo 42 opens the water valve 29 and water begins to flow out of the nozzle 30 under the gas pressure which is maintained in the head space 31. When the valve element 48 is in the dispensing position, the gas source 13 is still fluidly connected to the reservoir 14 through the actuated power valve 19. Simultaneously and concurrently, the same gas pressure is applied upon the pump 16 which immediately begins expelling syrup up to and out of the nozzle 30. When the serving is completed, the actuator button 66 is released and the spring-biased valve element 48 returns to its normal position which closes the inlet 35 and outlet 36 to the outlets 37, 38 and disconnects the compressed gas from the servo 42 and the respective pump 16, and which connects the outlets 37, 38 to the vent 47 and connects the pump 16 and servo 42 to atmosphere. Used propellant gas in the pump 16 and servo 42 immediately vents to atmosphere in the cooling chamber 12. The predetermined and identical head pressure in the servo 42 drops immediately because of the small volume, and it takes just a few seconds for the propellant chamber 85 to empty as the pumping chamber 84 refills with syrup. The syrup in the pump 16 is always maintained at least as cool as the syrup in the tank 15 so the water and syrup are dispensed at substantially the same temperature and pressure. The flows of syrup and water are combined at the nozzle 30 to form the cold post-mixed beverage be it non-carbonated with compressed air or carbonated with carbon dioxide gas. The transferring of syrup from the tank 15 to the pump 16 is done entirely within the tank 15 and there is no possibility of leakage or contamination.

In the apparatus 10 as shown, there are four actuators 66 and power valves 19, but only three syrup tanks 15 and pumps 16. The fourth actuator 66 and power valve 19 is for carbonated water, or cold water, only. One of the outlets 38 on the power valve 19 is connected to the servo 42, and the other outlet 37 is plugged. The fourth actuator 66 and power valve 19 is an effective option for cooled water, be it flat or carbonated.

For changing flavors, or cleaning or sanitizing of the syrup tanks and pumps, the disconnects 40, 51 are disconnected and the tank 15 and pump 16 removed from the apparatus 10. The normally closed check valves 52 prevent seepage from the nozzle 30. The tank 15 and pump 16 are completely self-draining out of the fill opening and the dispensing line 50 when the tank 15 and pump 16 are inverted. The retainers 63 hold the pump 16 when the tank 15 is inverted. The pump 16 is easily removed from the tank 15 and all tank 15 and pump 16 parts may be cleaned in a dishwasher.

The advantages of the apparatus 10 and method of the present invention are many. An outstanding feature is the silence of the apparatus 10. There is no cooling fan, no mechanical push-button or latches and the venting of compressed gas from the power valves 19, servo 42 and reservoir relief valve 32, and operation of the regulator 17 and the propellant and delivery lines and the pump 16 cannot be heard. The apparatus 10 is absolutely silent save for the compressor 74. The venting by the power valves 19 and servo 42 of propellant into the cooling chamber also seems to decrease frost build-up on the evaporator 75 because the used propellant gas is dry and it expels moisture bearing air. The apparatus 10 dispenses multiple flavors without the use of electric components or complicated parts. The pneumatic and liquid connections have been reduced to a minimum, and the failure of any of these connections will not result in spillage. The usual mess of pneumatic and beverage lines has been concealed. The apparatus 10 will work with carbonated or non-carbonated beverages. The apparatus 10 is a multiple flavor dispenser without electrical or mechanical switches, interlocks and mechanisms, and without multiple water valves and lines. The ratio of syrup to water is easily adjusted and is very accurate and repeatable because the syrup and water are at the same temperature and pressure. The syrup tank 15 and pumps 16 are normally not pressurized; only the pumps are intermittently pressurized. If a pump 16 leaks, the leakage stays in the tank 15. The tank 15 has no apertures to leak. The water, of which more is used, gets priority to the refrigeration cooling. The tank 15 and pumps 16 are easily cleaned, and flavor changes are easy. The syrup never contacts metal and there is no chance for metallic off-tastes. The quality of beverage dispensed by the apparatus 10 is so excellent that the beverage can be depended upon to be comparable to beverage from a glass bottle. Most importantly, the apparatus 10 is usable in a domestic household because it is simple. it is sanitary and not messy, it is foolproof and extremely reliable, it is leakproof, it is easily cleaned, it cannot explode, and it is easily diagnosed and repaired if not working as intended.

Although other advantages may be found and realized and various and minor modifications may be suggested by those versed in the art, be it understood that I wish to embody within the scope of the present warranted hereon, all such improvements as reasonably and properly come within the scope of my contribution to the art.

I claim:

1. Cold beverage dispensing apparatus powerable by compressed gas, comprising:

(a) a thermally insulated cabinet having a cooling chamber containing
  (1) a refrigeration evaporator
  (2) a source of compressed gas
  (3) a water reservoir sized to hold a plurality of servings of water,
  (4) a non-pressurized syrup tank sized to hold a plurality of servings of syrup, said tank having a breather to atmosphere within the cabinet, and
  (5) a normally non-pressurized syrup pump having a syrup inlet in fluid communication with the syrup tank;

(b) a normally closed water valve fluidly connected to an outlet of the reservoir;

(c) a dispensing nozzle on the outside of the cabinet, said nozzle being fluidly connected to the syrup pump and the water valve;

(d) a pneumatic dispensing power valve having an inlet connected to the source of compressed gas, an outlet connected to the syrup pump, a vent, and a valve element having a normal position in which the valve inlet is closed and the syrup pump is fluidly connected through the valve outlet to the vent, said valve element being selectively movable to an alternate dispensing position in which the inlet is fluidly connected to the outlet and the source of compressed gas is fluidly connected to the syrup pump, and in which the vent is closed;

(e) a manually operable dispensing actuator on the outside of the cabinet, said actuator being operatively connected to move the valve element to the dispensing position (f) the power valve outlet has a flow restrictor upstream of a gas line connecting the power valve to the pump, said gas line being frictionally connected to both the power valve and the pump.

2. The apparatus of claim 1, including a pneumatic water valve opening servo operatively connected to the water valve, and a second gas line fluidly connecting the servo to the power valve outlet.

3. A multiple flavor cold beverage dispensing apparatus powerable by compressed gas, comprising:

(a) a thermally insulated cabinet having a cooling chamber containing;
  (1) a refrigeration evaporator,
  (2) a source of compressed gas,
  (3) a water reservoir sized to hold a plurality of servings of water,
  (4) a plurality of non-pressurized syrup tanks, each having a breather to atmosphere within the cabinet, and
  (5) a normally non-pressurized syrup pump for each of said tanks and having a syrup inlet in fluid communication with a respective syrup tank;

(b) a normally closed water valve fluidly connected to an outlet of the reservoir;

(c) a pneumatic valve opening servo operatively connected to the water valve;

(d) a dispensing nozzle on the outside of the cabinet, said nozzle being fluidly connected to the syrup pumps and the water valve;

(e) a like plurality of pneumatic dispensing power valves each having an inlet fluidly connected to the source of compressed gas, an outlet connected to a respective syrup pump, a vent, and a valve element having a normal position in which the valve inlet is closed and the respective syrup pump is fluidly connected through the valve to the vent, said valve element being selectively movable to an alternate dispensing position in which the inlet is fluidly connected to the outlet and the source of compressed gas is fluidly connected to the respective syrup pump, and in which the vent is closed;

(f) manually operable dispensing actuators on the outside of the cabinet, said actuators being operatively connected to move a respective valve element to the dispensing position; and in which (g) each power valve is individually connected to the servo, said servo having a pneumatic OR logic mechanism, and in which (h) the servo has a servo chamber for each power valve, and barriers which fluid tightly separate the servo chambers from each other.

4. A pneumatically powerable multi-flavor post-mix carbonated beverage dispensing apparatus comprising:

(a) a source of carbon dioxide gas having means for regulating the pressure of the gas;

(b) a source of cold carbonated water under pressure;

(c) a plurality of non-pressurized syrup storage tanks, each syrup tank being sized to hold a quantity of syrup sufficient for dispensing a plurality of servings of post-mix carbonated beverage, each syrup tank having a breather to atmosphere;

(d) a like plurality of pneumatically powerable syrup pumps, each pump having a syrup inlet in fluid communication with a respective syrup tank;

(e) a normally closed water valve having an inlet in fluid communication with the carbonated water source;

(f) a dispensing nozzle connected by a water dispensing line to an outlet of the water valve, and to an outlet of a respective syrup pump by a syrup dispensing line;

(g) a pneumatic servo for opening the water valve and being operatively connected thereto;

(h) a like plurality of pneumatic power valves for dispensing, each power valve having (1) an inlet in fluid communication with the carbon dioxide source, (2) first and second outlets in fluid communication with a respective syrup pump and with the servo respectively, (3) a vent, and (4) a valve element movable from a normal postion in which the inlet is closed to the outlets and the outlets are fluidly connected to the vent, to an alternate dispensing position in which the inlet is fluidly connected to the outlets and the outlets are closed to the vent;

(i) a dispensing actuator connected to move a selected valve element from the normal position to the dispensing position;

(j) a carbon dioxide gas supply line connecting the gas source to the water source, with the supply line extending through the power valves; and in which (k) each power valve has a third outlet, said inlet of a first power valve of said plurality of pneumatic power valves being directly connected to the gas source, said third outlet of a last power valve of said plurality of pneumatic power valves being connected to the head space, said third outlet of the first power valve of said plurality of said pneumatic power valves being connected to the inlet of the next power valve of said plurality of pneumatic power valves and so on until said third outlet of the next to the last power valve of said plurality of pneumatic power valves is connected to the inlet of the last power valve.

5. Cold beverage dispensing apparatus powerable by compressed gas, comprising (a) a thermally insulated cabinet having a cooling chamber containing (1) a refrigeration evaporator, (2) a source of compressed gas (3) an upright cylindrical reservoir sized to hold a plurality of servings of water, (4) a non-pressurized syrup tank sized to hold a plurality of servings of syrup, said tank having a breather to atmosphere within the cabinet, and (5) a pneumatically powerable and normally non-pressurized syrup pump having a syrup inlet in fluid communication with the syrup tank;

(b) a normally closed water valve fluidly connected to an outlet of the reservoir;

(c) a dispensing nozzle on the outside of the cabinet, said nozzle being fluidly connected to the syrup pump and to the water valve;

(d) a pneumatic dispensing power valve having an inlet connected to the gas source, an outlet connected to the syrup pump, a vent, and a valve element having a normal position in which the valve inlet is closed and the valve outlet and the syrup pump are fluidly connected to the vent, said valve element being selectively movable to an alternate dispensing position in which the valve inlet is fluidly connected to the valve outlet and the gas source is fluidly connected to the syrup pump, and in which the vent is closed;

(e) a manually operable dispensing actuator on the outside of the cabinet, said actuator being operatively connected to move the valve element from the normal position to the dispensing position and to effect opening of the water valve;

(f) said refrigeration evaporator being within the cooling chamber, said evaporator having a U-shape when viewed from above with a base of the U-shape being along a back side of the cooling chamber and rearward of the reservoir and each leg of the U-shape extending forward alongside a respective side of the cooling chamber, each leg extending toward a front side of the cabinet, said evaporator being spaced up and off of a bottom of the cooling chamber and being positioned in the upper part of and adjacent to a top of the cooling chamber, the uppermost part of the reservior being positioned just forward of the base of the U-shape and between the legs, said syrup tank being mounted forward of the reservoir, and (g) in which each leg of the evaporator has fore-aft length which is longer than a diameter of the reservoir, said reservoir being completely within the profile of the U-shaped evaporator when viewed from above, the syrup tank being mounted on a normally closed door on the front of the cabinet said syrup tank being at least partially in between the evaporator legs when viewed from above, the tank being pivotable out of its position between the legs and out of cooling chamber when the door is open.

6. A method of dispensing one of plurality of flavors of cold carbonated post-mix beverages, comprising the steps of:

(a) cooling a reserve of water to just above freezing;

(b) cooling a plurality of tanks of syrup at ambient pressure to substantially the same temperature of the cooled water;

(c) pressurizing the water with a head pressure of compressed carbon dioxide gas at a regulated predetermined pressure, and carbonating the water;

(d) transferring by gravity a fraction of the syrup in each syrup tank into a normally non-pressurized compressed gas powerable syrup pump and maintaining the syrup in each pump at least as cool as syrup in the syrup tank;

(e) concurrently dispensing cooled water and a selected one syrup at substantially the same pressure and temperature by simultaneously;

(1) fluidly connecting the compressed carbon dioxide gas to a selected one of the syrup pumps and propelling syrup from the selected one pump to a dispensing nozzle with the head pressure, while (2) fluidly connecting the carbon dioxide gas at the head pressure to a single one of plurality of pressure chambers in a pneumatic servo operatively connected to the water valve for opening the water valve, and thereby effecting pneumatic opening of the water valve regardless of which syrup has been selected and propelling carbonated water with and under the head pressure through the opened water valve and to the dispensing nozzle;

(f) combining the flows of carbonated water and the selected one syrup to form a cold carbonated post-mixed beverage; and (g) terminating dispensing by closing the water valve and disconnecting the compressed carbon dioxide gas pressure from the syrup pump and from the servo, and then venting used carbon dioxide gas from the pump and the servo.

7. The method of claim 6, including the step of venting used carbon dioxide gas from the servo into a water and syrup cooling chamber.

8. A multiple flavor cold beverage dispensing apparatus powerable by compressed gas, comprising:

(a) a thermally insulated cabinet having a cooling chamber containing (1) a refrigeration evaporator, (2) a source of compressed gas, (3) a water reservoir sized to hold a plurality of servings of water, (4) a plurality of non-pressurized syrup tanks, each having a breather to atmosphere within the cabinet, and (5) a normally non-pressurized syrup pump for each of said tanks and having a syrup inlet in fluid communication with a respective syrup tank;

(b) a normally closed water valve fluidly connected to an outlet of the reservoir;

(c) a pneumatic valve opening servo operatively connected to the water valve;

(d) a dispensing nozzle on the outside of the cabinet, said nozzle being fluidly connected to the syrup pumps and the water valve;

(e) a like plurality of pneumatic dispensing power valves each having an inlet fluidly connected to the source of compressed gas, an outlet connected to a respective syrup pump, a vent, and a valve element having a normal position in which the valve inlet is closed and the respective syrup pump is fluidly connected through the valve outlet to the vent, said valve element being selectively movable to an alternate dispensing position in which the inlet is fluidly connected to the outlet and the source of compressed gas is fluidly connected to the respective syrup pump, and in which the vent is closed;

(f) manually operable dispensing actuators on the outside of the cabinet, said actuators being operatively connected to move a respective valve element to the dispensing position; and in which (g) said power valves are connected in series.

9. The apparatus of claim 8, in which each power valve outlet comprises a first and second outlet, the first outlet being in fluid communication with a respective syrup pump, and the second outlet being in fluid communication with the servo.

10. The apparatus of claim 8, in which the servo is mounted inside of a cabinet door.

11. The machine of claim 8 in which each power valve is individually connected to the servo, said servo having a pneumatic OR logic mechanism.

12. The apparatus of claim 8, including a carbonated water power valve having a like said inlet, vent and valve element as said pneumatic power valves, said carbonated water power valve having a servo outlet connected only to the servo, said gas source being a source of carbon dioxide gas.

13. A pneumatically powerable multi-flavor post-mix carbonated beverage dispensing apparatus comprising:

(a) a source of carbon dioxide gas having means for regulating the pressure of the gas;

(b) a source of cold carbonated water under pressure;

(c) a plurality of non-pressurized syrup storage tanks, each syrup tank being sized to hold a quantity of syrup sufficient for dispensing a plurality of servings of post-mix carbonated beverage, each syrup tank having a breather to atmosphere;

(d) a like plurality of pneumatically powerable syrup pumps, each pump having a syrup inlet in fluid communication with a respective syrup tank;

(e) a normally closed water valve having an inlet in fluid communication with the carbonated water source;

(f) a dispensing nozzle connected by a water dispensing line to an outlet of the water valve, and to an outlet of a respective syrup pump by a syrup dispensing line;

(g) a pneumatic servo for opening the water valve;

(h) a like plurality of pneumatic power valves for dispensing, each power valve having (1) an inlet in fluid communication with the carbon dioxide source, (2) outlets in fluid communication with a respective syrup pump and with the servo, (3) a vent, and (4) a valve element movable from a normal position in which the inlet is closed to the outlets and the outlets are fluidly connected to the vent, to an alternate dispensing position in which the inlet is fluidly connected to the outlets and the outlets are closed to the vent;

(i) a dispensing actuator connected to move a selected valve element from the normal position to the dispensing position; and in which (j) a carbon dioxide gas supply line connects the gas source to the water source with the supply line extending through the power valves, said power valves being connected in series in the gas supply line.

14. The appartus of claim 13, in which said outlets of each power valve comprises a first and second outlet, the first outlet being in fluid communication with a respective syrup pump, and the second outlet being in fluid communication with the servo.

15. The apparatus of claim 13 in which each power valve is individually connected to the servo, said servo having a pneumatic OR logic mechanism.

16. The apparatus of claim 13, including a carbonated water power valve having a like inlet, vent and valve element as said pneumatic power valves, and also having a servo outlet in fluid communication only with the servo.

17. Cold beverage dispensing apparatus powerable by compressed gas, comprising (a) a thermally insulated cabinet having a cooling chamber containing
  (1) a refrigeration evaporator,
  (2) a source of compressed gas
  (3) a water reservoir sized to hold a plurality of servings of water,
  (4) a non-pressurized syrup tank sized to hold a plurality of servings of syrup, said tank having a breather to atmosphere within the cabinet and a normally closed and removable filling cover on a top of the tank, and
  (5) a pneumatically powerable and normally non-pressurized syrup pump inside of the syrup tank, said pump having a syrup inlet in fluid communication with the syrup tank;
(b) a normally closed water valve fluidly connected to an outlet of the reservoir;
(c) a dispensing nozzle on the outside of the cabinet, said nozzle being fluidly connected to the syrup pump and to the water valve;
(d) a pneumatic dispensing power valve having an inlet connected to the gas source, an outlet connected to the syrup pump, a vent, and a valve element having a normal position in which the valve inlet is closed and the valve outlet and the syrup pump are fluidly connected to the vent, said valve element being selectively movable to an alternate dispensing position in which the valve inlet is fluidly connected to the valve outlet and the gas source is fluidly connected to the syrup pump, and in which the vent is closed;
(e) a manually operable dispensing actuator on the outside of the cabinet, said actuator being operatively connected to move the valve element from the normal position to the dispensing position;
(f) a syrup dispensing line connecting the pump to the nozzle, said syrup dispensing line entering into the syrup tank through the top of the tank, said syrup dispensing line having a disconnect outside of the tank and a normally closed check valve between the disconnect and the nozzle;
(g) a rack inside of the cabinet and in the cooling chamber, said rack supporting the syrup tank, the syrup tank being disconnectible by separation of the syrup delivery line disconnect and being removable from the rack and the apparatus; and in which
(h) the syrup pump has a filling check valve inside of and adjacent to a bottom of the syrup tank, the syrup tank and pump and that part of the syrup delivery line between the pump and the disconnect all being completely self-draining as a unit when removed from the apparatus and inverted.

18. The apparatus of claim 17, including a pump gas line connecting the power valve outlet to the syrup pump, said pump gas line entering into the syrup tank through a top of said tank.

19. The apparatus of claim 17, in which the tank has a retainer holding the pump on a bottom of the syrup tank.

20. The apparatus of claim 17, in which the pump has an upward extending handle inside of the tank.

21. The apparatus of claim 17, for multi-flavors, including (a) a plurality of said syrup tanks;
(b) a like plurality of said syrup pumps, each pump having its syrup inlet in fluid communication with a respective syrup tank;
(c) a pneumatic valve opening servo operatively connected to the water valve;
(d) a like plurality of said power valves, each power valve having its outlet fluidly connected to a respective syrup pump and to the servo.

22. The apparatus of claim 21, including a carbon dioxide gas supply line connecting the gas source to a gas filled head space above a water level in the water reservoir, said gas line extending through the power valves, said gas source being a source of carbon dioxide gas.

23. The apparatus of claim 17, in which the evaporator is on the back side of the cooling chamber, and in which the syrup tank is mounted on the front side of the cooling chamber.

24. The apparatus of claim 23, in which the evaporator extends around each side of the water reservoir.

25. The apparatus of claim 24, in which the syrup tank is mounted on the door, the tank being pivotable out of the cooling chamber when the door is opened.

26. Cold beverage dispensing apparatus powerable by compressed gas, comprising:

(a) a thermally insulated cabinet having a cooling chamber containing;
  (1) a refrigeration evaporator,
  (2) a source of compressed gas,
  (3) a water reservoir sized to hold a plurality of servings of water,
  (4) a non-pressurized syrup tank sized to hold a plurality of servings of syrup, said tank having a breather to atmosphere within the cabinet, and
  (5) a normally non-pressurized syrup pump having a syrup inlet in fluid communication with the syrup tank;
(b) a normally closed water valve fluidly connected to an outlet of the reservoir;
(c) a dispensing nozzle on the outside of the cabinet, said nozzle being fluidly connected to the syrup pump and the water valve;
(d) a pneumatic dispensing power valve having an inlet connected to the source of compressed gas, an outlet connected to the syrup pump, a vent, and a valve element having a normal position in which the valve inlet is closed and the syrup pump is fluidly connected through the valve outlet to the vent, said valve element being selectively movable to an alternate dispensing position in which the inlet is fluidly connected to the outlet and the source of compressed gas is fluidly connected to the syrup pump, and in which the vent is closed;
(e) a manually operable dispensing actuator on the outside of the cabinet, said actuator being operatively connected to move the valve element to the dispensing position;

(f) a pneumatic opening servo operatively connected to the water valve, and a gas line fluidly connecting the servo to the power valve outlet, said water valve servo being normally fluidly connected to the power valve vent.

27. The apparatus of claim 26, in which the power valve vent is in the cooling chamber.

28. The apparatus of claim 26, in which the water reservoir has a circular profile when viewed from above, in which the evaporator has a U-shape when viewed from above, and in which the evaporator is larger than and is wrapped around at least half of the reservoir.

29. The apparatus of claim 26, including a pair of wheels along and under a lower edge of a back panel of the cabinet, a pair of spacer handles projecting rearward from adjacent an upper edge of the cabinet back panel, a refrigeration condenser on the back panel and in between the wheels and the spacer handles, and a water supply line extending through and down the outside of the cabinet back panel.

30. The machine of claim 29, including a cabinet door which comprises a front side of the cabinet, said nozzle being mounted on an outside surface of the door.

31. The machine of claim 29, in which the dispensing actuator is a downwardly depressible push button.

32. The machine of claim 29, in which the water reservoir is mounted in said cabinet adjacent to the back panel and just forward of the wheels.

33. The machine of claim 32, including a refrigeration compressor laterally between the wheels and directly under the water reservoir.

34. The apparatus of claim 26, in which the compressed gas source is a supply of carbon dioxide gas.

35. The apparatus of claim 34, including a water pump for filling the reservoir, said water pump being within the cooling chamber and underneath the evaporator.

36. The apparatus of claim 34, in which the supply comprises a carbon dioxide bottle and a pre-set carbon dioxide pressure regulator mounted in a gas bottle rack within the cooling chamber.

37. The apparatus of claim 36, in which the gas bottle, the regulator and the bottle rack are mounted on an inside surface of a cabinet door.

38. The apparatus of claim 37, in which the bottle, regulator and bottle rack are immediately adjacent a hinge upon which the door is pivotally mounted.

* * * * *